US006026744A

United States Patent [19]

Miyata

[11] Patent Number: 6,026,744

[45] Date of Patent: Feb. 22, 2000

[54] STENCIL PRINTER AND METHOD OF STENCIL PRINTING

[75] Inventor: Masakazu Miyata, Ibaraki-ken, Japan

[73] Assignee: Riso Kagaku Corporation, Tokyo, Japan

[21] Appl. No.: 09/107,365

[22] Filed: Jun. 30, 1998

[30] Foreign Application Priority Data

Jul. 1, 1997 [JP] Japan ..... 9-175875

[51] Int. Cl.[7] ..... B41L 13/00

[52] U.S. Cl. ..... 101/118; 101/116; 101/129

[58] Field of Search ..... 101/114, 116, 101/117, 118, 128.4, 129

[56] References Cited

U.S. PATENT DOCUMENTS 5,165,338 11/1992 Okazaki et al. ..... 101/118
5,207,157 5/1993 Okazaki et al. ..... 101/116
5,224,419 7/1993 Fukai ..... 101/128.4
5,404,805 4/1995 Fujimoto et al. ..... 101/118
5,575,205 11/1996 Iida ..... 101/116
5,632,200 5/1997 Fukai ..... 101/114

*Primary Examiner*—Stephen R. Funk
*Attorney, Agent, or Firm*—Sixbey, Friedman, Leedom & Ferguson, PC; Donald R. Studebaker

[57] ABSTRACT

In stencil printing, a printing matrix is thermally made in a printing matrix area on a stencil material on the basis of image information representing an image on an original. The printing matrix area is determined according to the sheet size of printing paper sheet. The stencil thus obtained is wrapped around a printing drum and a printing paper sheet fed toward the printing drum is pressed against the printing drum by a pressure member. A memory which is provided on the printing drum side stores information on the area of the printing matrix. The sheet size is compared with the area of the printing matrix based on information extracted from the memory. When the former is smaller than the latter, printing is inhibited and an error signal which advises against printing is output.

11 Claims, 7 Drawing Sheets

STENCIL PRINTER AND METHOD OF STENCIL PRINTING

BACKGROUND OF THE INVENTION

1. Field of the Invention

This invention relates to a stencil printer and a method of stencil printing in which the printing matrix area formed on a stencil is determined depending on the size of printing papers.

2. Description of the Related Art

As a stencil printer, there has been known one comprising a cylindrical drum having a porous circumferential wall on which a stencil is mounted, an ink supply section which supplies the inner surface of the circumferential wall with ink, and a pressure roller which is disposed in parallel to the drum at a predetermined distance therefrom. Sheets of paper are supplied between the cylindrical drum and the pressure roller from a sheet feed section when printing.

In the stencil printers of this type, ink is transferred to the sheets through the printing matrix which is formed in the stencil by thermally perforating the stencil. Depending on the relation between the size of the printing matrix area and the size of the printing paper, there arises a problem that the surface of the pressure roller is stained.

Specifically in the case where a stencil having a printing matrix area corresponding to the A3 size is mounted on the drum, when printing is started with sheets of printing paper smaller than the A3 size (e.g., of the A4 size, the B5 size or the like) stacked on a paper feed table, the printing matrix area projects outward beyond the edges of the printing paper and ink passing through the stencil in the projecting portions of the printing matrix area is transferred to the pressure roller to stain the surface of the pressure roller. When printing is continued in that state, the ink on the pressure roller is transferred to the back side of the printing paper, which results in contamination of the printed papers.

Further in the printing drums used in such stencil printers, since ink is impregnated into the porous structure portion of the drum and passes through the printing matrix area of the stencil, each drum is used for one color only, for instance, one for black, one for red, one for blue and so on. Accordingly when the printing color is to be changed, the drum is replaced.

Here it is assumed that a stencil printer A prints on A3 size sheets with a drum for black while a stencil printer B prints on A4 size sheets with a drum for red. Then it is further assumed that necessity of changing the printing color from red to black without changing the printing size (A4) arises in the stencil printer B. In this case, when the operator removes the drum for black which has been used in the stencil printer A and mounts the drum on the printer B in place of the drum for red without taking into the difference in sheet size, black ink is supplied over an area of the drum surface corresponding to the printing matrix area of the A3 size sheets which is larger than the A4 size sheets and the black ink supplied in the portion outside the A4 size sheets is transferred to the pressure roller. A similar problem arises when the printing size is reduced to a size smaller than A3 in the stencil printer A.

SUMMARY OF THE INVENTION

In view of the foregoing observations and description, the primary object of the present invention is to provide a stencil printer and a method of stencil printing in which contamination with ink of the pressing part which is pressed against the printing drum during printing is prevented.

Another object of the present invention is to provide a stencil printer and a method of stencil printing in which the entire image on the printing matrix area can be printed on the printing paper without a part of the image being cut, whereby a desired printing can be obtained according to the printing matrix area.

In accordance with a first aspect of the present invention, there is provided a stencil printer comprising an image recording section which thermally makes a printing matrix on a stencil on the basis of image information representing an image on an original, a printing drum around which the stencil is wrapped, a paper feed section which supports a printing paper sheet stack and feeds the sheets in the stack toward the printing drum, and a pressure member which is opposed to the printing drum and presses the sheet against the printing drum, the sheet size of the printing paper sheets supported by the paper feed section being detected by a sheet size sensor provided on the paper feed section and the area of the printing matrix to be made by the image recording section being determined according to the sheet size, wherein the improvement comprises a storage means which is provided on the printing drum side and stores information on the area of the printing matrix, and a control system which compares the sheet size detected by the sheet size sensor with the area of the printing matrix based on information extracted from the storage means and inhibits printing and/or outputs an error signal which advises against printing when the former is smaller than the latter.

In accordance with a second aspect of the present invention, there is provided a stencil printer comprising an image read-out section which optically reads out an image on an original, an image recording section which thermally makes a printing matrix on a stencil on the basis of image information representing the image on the original read out by the image read-out section, a printing drum around which the stencil is wrapped, a paper feed section which supports a printing paper sheet stack and feeds the sheets in the stack toward the printing drum, and a pressure member which is opposed to the printing drum and presses the sheet against the printing drum, the sheet size of the printing paper sheets supported by the paper feed section being detected by a sheet size sensor provided on the paper feed section and the area of the printing matrix to be made by the image recording section being determined according to the sheet size, wherein the improvement comprises a storage means which is provided on the printing drum side and stores information on the area of the printing matrix, the area of the printing matrix being determined on the basis of comparison of an image area on the original and a printing area corresponding to the sheet size minus a predetermined margin to be equal to the image area when the latter is not smaller than the former and to be equal to the printing area when the latter is smaller than the former, and a control system which compares the sheet size detected by the sheet size sensor with the area of the printing matrix based on information extracted from the storage means and inhibits printing and/or outputs an error signal which advises against printing when the former is smaller than the latter.

In accordance with a third aspect of the present invention, there is provided a stencil printer comprising an image read-out section which optically reads out an image on an original, an image recording section which thermally makes a printing matrix on a stencil on the basis of image information representing the image on the original read out by the image read-out section, a printing drum around which the stencil is wrapped, a paper feed section which supports a printing paper sheet stack and feeds the sheets in the stack toward the printing drum, and a pressure member which is opposed to the printing drum and presses the sheet against the printing drum, the sheet size of the printing paper sheets supported by the paper feed section being detected by a sheet size sensor provided on the paper feed section and the area of the printing matrix to be made by the image recording section being determined according to the sheet size, wherein the improvement comprises a storage means which is provided on the printing drum side and stores information on the area of the printing matrix, the area of the printing matrix being determined on the basis of comparison of an image area on the original and a printing area corresponding to the sheet size to be equal to the image area when the latter is not smaller than the former and to be equal to the printing area when the latter is smaller than the former, and a control system which compares the sheet size detected by the sheet size sensor with the area of the printing matrix based on information extracted from the storage means and inhibits printing and/or outputs an error signal which advises against printing when the former is smaller than the latter.

Preferably there is provided an alarm means which alarms that the image on the original is not correctly represented by the printing matrix when the printing area is smaller than the image area on the original and the area of the printing matrix is determined to be equal to the printing area.

In accordance with a fourth aspect of the present invention, there is provided a stencil printer comprising an image read-out section which optically reads out an image on an original, an original detecting means which is provided in the image read-out section and detects the size of the original, an image recording section which thermally makes a printing matrix on a stencil on the basis of image information representing the image on the original read out by the image read-out section, a printing drum around which the stencil is wrapped, a paper feed section which supports a printing paper sheet stack and feeds the sheets in the stack toward the printing drum, and a pressure member which is opposed to the printing drum and presses the sheet against the printing drum, the sheet size of the printing paper sheets supported by the paper feed section being detected by a sheet size sensor provided on the paper feed section and the area of the printing matrix to be made by the image recording section being determined according to the sheet size, wherein the improvement comprises a storage means which is provided on the printing drum side and stores information on the area of the printing matrix, the area of the printing matrix being determined on the basis of comparison of the size of the original detected by the original size detecting means and the sheet size to be equal to the size of the original when the latter is not smaller than the former and to be equal to the printing area when the latter is smaller than the former, and a control system which compares the sheet size detected by the sheet size sensor with the area of the printing matrix based on information extracted from the storage means and inhibits printing and/or outputs an error signal which advises against printing when the former is smaller than the latter.

Preferably there is provided an alarm means which alarms that the image on the original is not correctly represented by the printing matrix when the sheet size is smaller than the size of the original and the area of the printing matrix is determined to be equal to the sheet size.

In accordance with a fifth aspect of the present invention, there is provided a method of stencil printing wherein a printing matrix is thermally made in a printing matrix area on a stencil material on the basis of image information representing an image on an original, the printing matrix area being determined according the sheet size of printing paper sheet, the stencil thus obtained is wrapped around a printing drum, and a printing paper sheet fed toward the printing drum is pressed against the printing drum by a pressure member, wherein the improvement comprises the steps of causing a storage means which is provided on the printing drum side to store information on the area of the printing matrix, comparing the sheet size with the area of the printing matrix based on information extracted from the storage means, and inhibiting printing and/or outputting an error signal which advises against printing when the former is smaller than the latter.

In accordance with a sixth aspect of the present invention, there is provided a method of stencil printing wherein a printing matrix is thermally made in a printing matrix area on a stencil material on the basis of image information representing an image on an original, the printing matrix area being determined according to the sheet size of printing paper sheet, the stencil thus obtained is wrapped around a printing drum, and a printing paper sheet fed toward the printing drum is pressed against the printing drum by a pressure member, wherein the improvement comprises the steps of causing a storage means which is provided on the printing drum side to store information on the area of the printing matrix, the area of the printing matrix being determined on the basis of comparison of an image area on the original and a printing area corresponding to the sheet size minus a predetermined margin to be equal to the image area when the latter is not smaller than the former and to be equal to the printing area when the latter is smaller than the former, and comparing the sheet size with the area of the printing matrix based on information extracted from the storage means, and inhibiting printing and/or outputting an error signal which advises against printing when the former is smaller than the latter.

In accordance with a seventh aspect of the present invention, there is provided a method of stencil printing wherein a printing matrix is thermally made in a printing matrix area on a stencil material on the basis of image information representing an image on an original, the printing matrix area being determined according the sheet size of printing paper sheet, the stencil thus obtained is wrapped around a printing drum, and a printing paper sheet fed toward the printing drum is pressed against the printing drum by a pressure member, wherein the improvement comprises the steps of causing a storage means which is provided on the printing drum side to store information on the area of the printing matrix, the area of the printing matrix being determined on the basis of comparison of an image area on the original and a printing area corresponding to the sheet size to be equal to the image area when the latter is not smaller than the former and to be equal to the printing area when the latter is smaller than the former, and comparing the sheet size with the area of the printing matrix based on information extracted from the storage means, and inhibiting printing and/or outputting an error signal which advises against printing when the former is smaller than the latter.

In accordance with an eighth aspect of the present invention, there is provided a method of stencil printing wherein a printing matrix is thermally made in a printing matrix area on a stencil material on the basis of image information representing an image on an original, the printing matrix area being determined according the sheet size of printing paper sheet, the stencil thus obtained is wrapped around a printing drum, and a printing paper sheet fed toward the printing drum is pressed against the printing drum by a pressure member, wherein the improvement comprises the steps of causing a storage means which is provided on the printing drum side to store information on the area of the printing matrix, the area of the printing matrix being determined on the basis of comparison of the size of the original and the sheet size to be equal to the size of the original when the latter is not smaller than the former and to be equal to the printing area when the latter is smaller than the former, and comparing the sheet size with the area of the printing matrix based on information extracted from the storage means, and inhibiting printing and/or outputting an error signal which advises against printing when the former is smaller than the latter.

DESCRIPTION OF THE PREFERRED EMBODIMENTS

Figure 1:
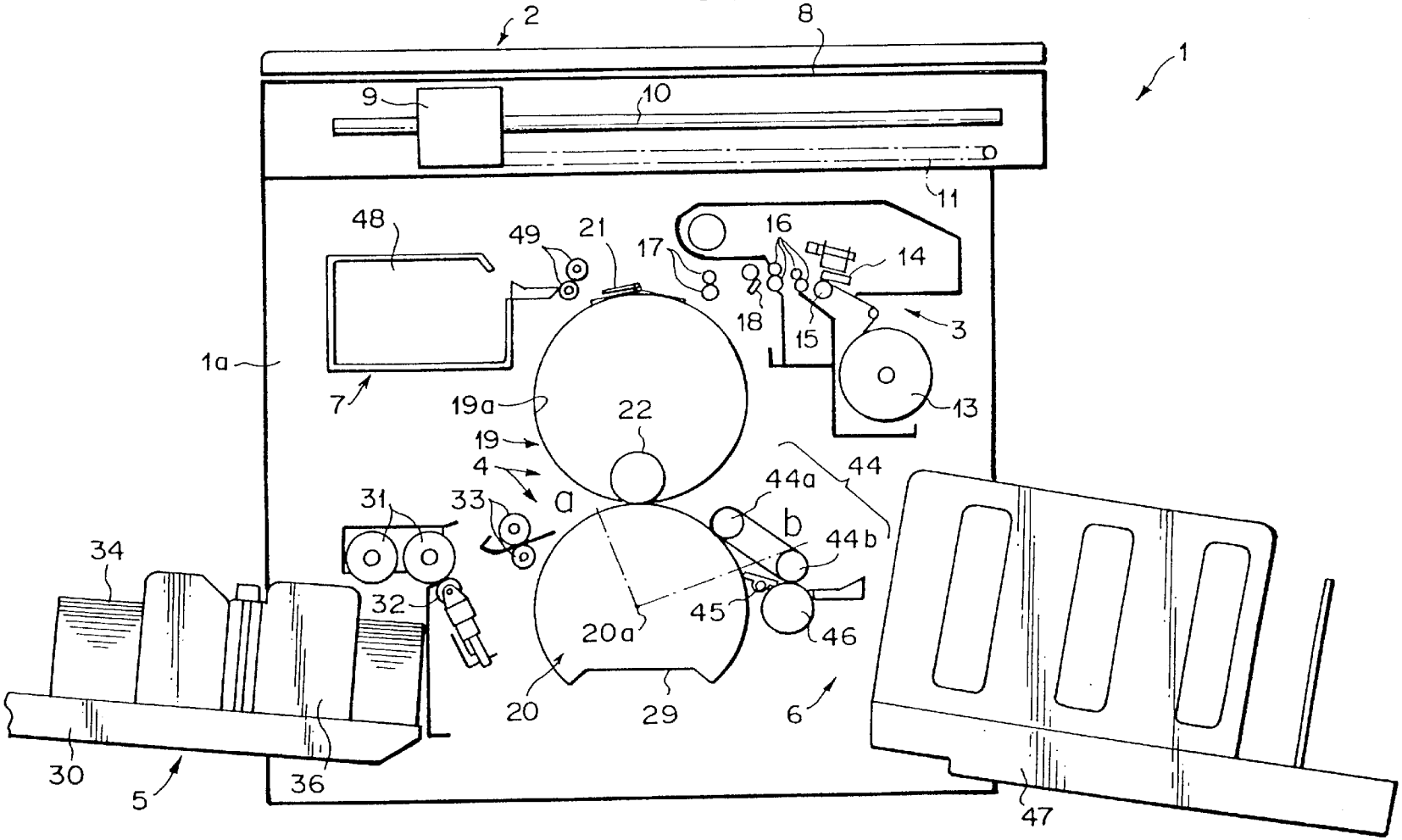
FIG. 1 is a schematic view showing a stencil printer in accordance with an embodiment of the present invention.

In FIG. 1 a stencil printer 1 in accordance with an embodiment of the present invention, comprises an image read-out section 2, an image recording section 3, a printing section 4, a paper feed section 5, a paper discharge section 6 and a stencil discharge section 7.

The image read-out section 2 comprises an image scanner 9 which is disposed to cover the entire width (the dimension in a main scanning direction) of an original placed on a glass platen 8 with its image side facing the platen 8. The image scanner 9 comprises an optical system formed by a light source, mirrors, lenses and the like and a CCD sensor, and is supported by a guide bar 10 to be driven by an electric motor (not shown) by way of an endless belt 11.

The image scanner 9 is moved along the guide bar 10 in the longitudinal direction of the original (a sub-scanning direction) when the electric motor is energized to drive the endless belt 11 under the control of a CPU 51 of a control system 50 to be described later, and reads out the image on the original line by line. The image scanner 9 inputs the image information thus obtained into the CPU 51 of the control system 50.

Figure 3:
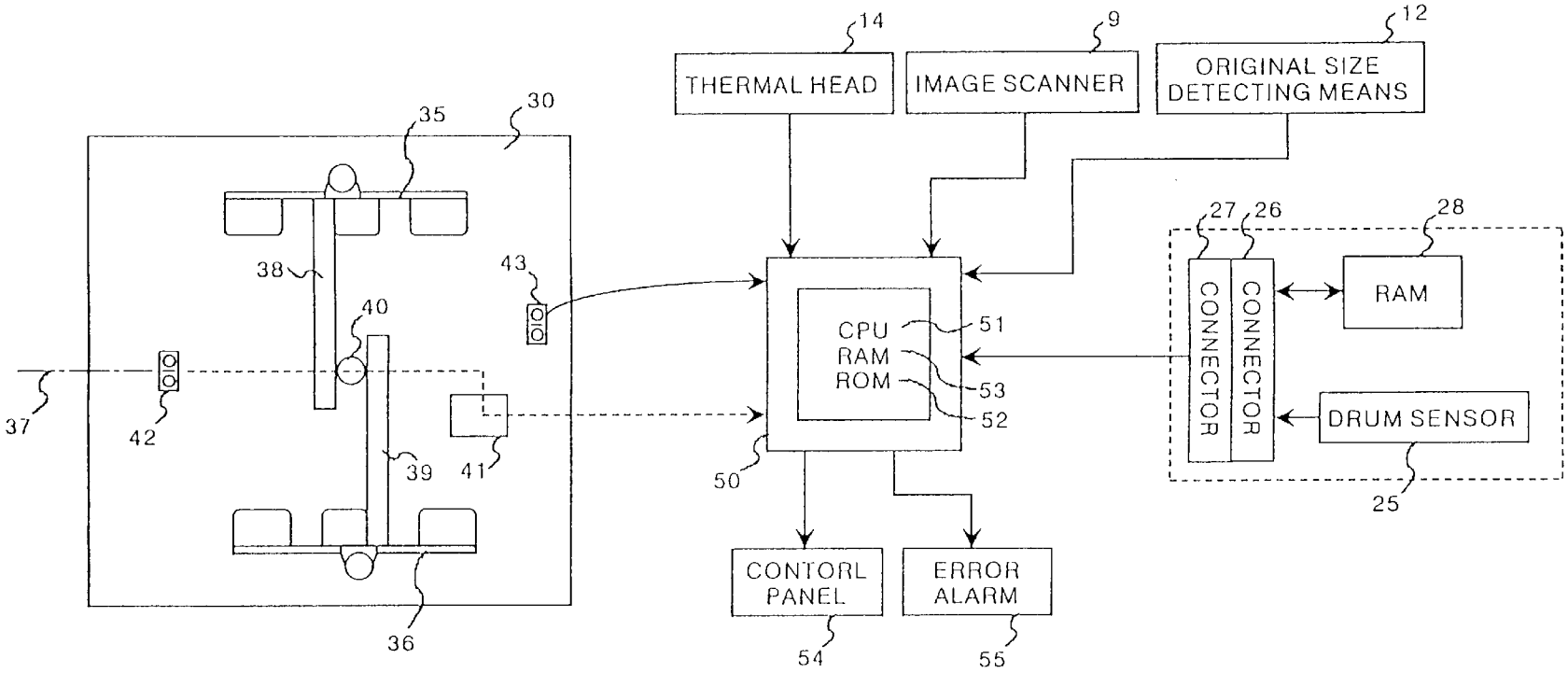
FIG. 3 is a block diagram of the control system of the printer.

The image read-out section 2 is provided with an original size detecting means 12 (FIG. 3). For example, the original size detecting means 12 may comprise a plurality of reflective sensors disposed opposed to the glass platen 8 in positions corresponding to regular original sizes. The original size detecting means 12 detects the size of the original placed on the platen 8 and inputs a detecting signal representing the size of the original into the CPU 51 of the control system 50.

The image recording section 3 comprises a roll 13 of a stencil material in a continuous length, a thermal head 14, a platen roller 15, a feed roller 16, a guide roller 17 and a cutter 18. The thermal head 14 comprises an array of a plurality of point heaters. Each time the image read-out section 2 reads out image data for one line of the original, the line data is transferred to the thermal head 14 by way of the CPU 51 of the control system 50.

In the image recording section 3, the point heaters of the thermal head 14 are selectively caused to generate heat on the basis of the line data transferred from the image read-out section 2. The stencil material is heat-sensitive and the image information is thus thermally recorded on the stencil material in a dot matrix over a printing matrix area determined by the control system 50. Then the thus formed stencil is cut away from the stencil material roll 13 by the cutter 18.

The printing section 4 comprises a drum 19 and a pressure roller 20. The drum 19 is cylindrical and is formed of a material permeable to ink such as a flexible mesh material. The stencil is wrapped around the drum 19 and is clamped by a clamp 21.

An inner pressure roller 22 is disposed inside the drum 19 to be opposed to the pressure roller 20. The longitudinal axis of the inner pressure roller 22 is parallel to the generatrix of the drum 19 and the inner pressure roller 22 is in contact with the inner surface 19*a* of the drum 19. A predetermined amount of ink is supplied to the inner surface 19*a* of the drum 19 by way of the circumferential surface of the inner pressure roller 22 by an ink supply system (not shown).

Figure 2:
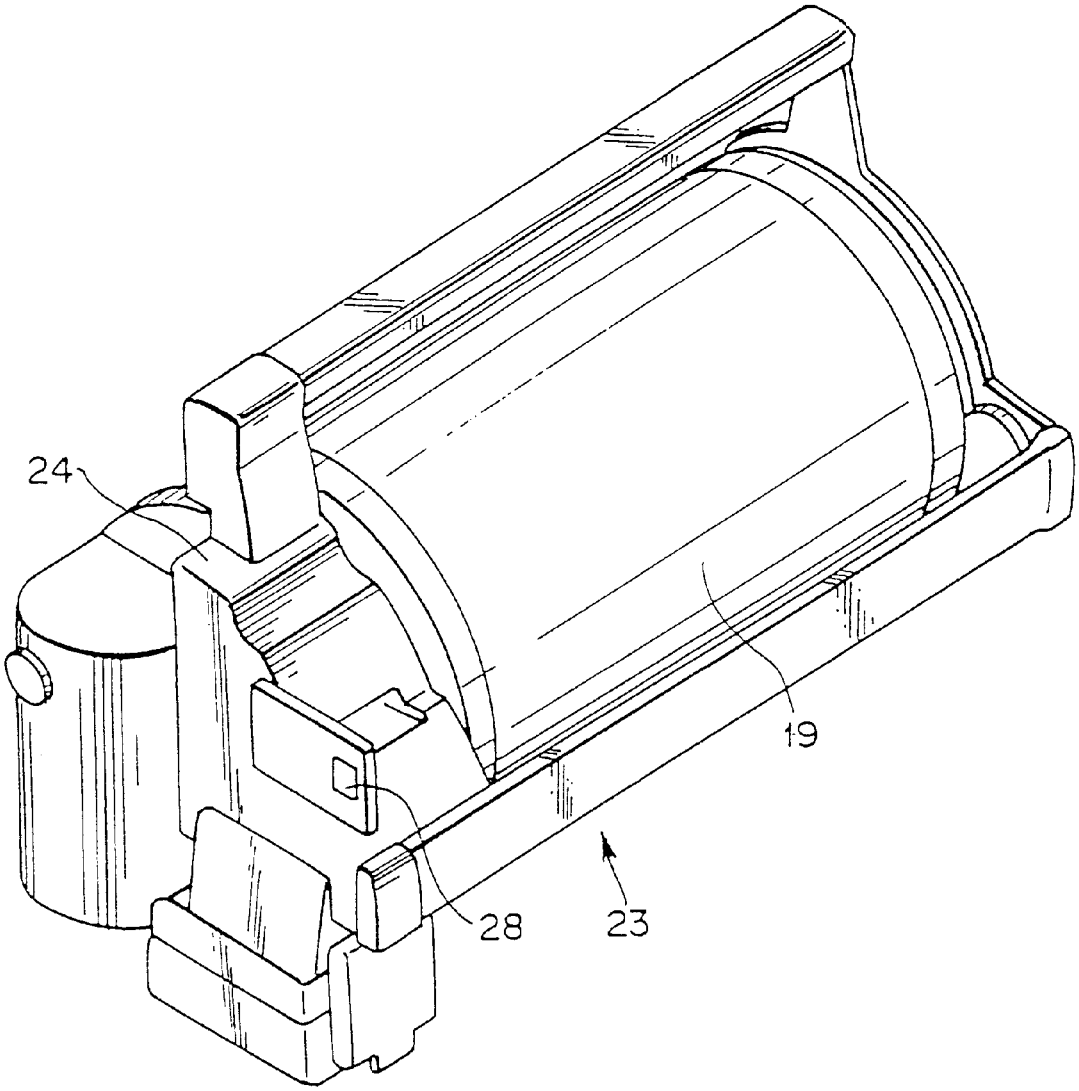
FIG. 2 is a perspective view of the support system for supporting the drum.

As shown in FIG. 2, the drum 19 is supported for rotation on a frame 24 of a unitized support system 23. The support system 23 can be drawn out from the printer body 1*a* so that it can be replaced. A drum sensor 25 detects whether the drum 19 is on the printer body 1*a*.

For example, the drum sensor 25 may comprise a transmission type optical sensor formed by a light emission sensor and a light reception sensor and a light-shielding plate on the support system 23. When the support system 23 is properly set to the printer body 1*a*, light emitted from the light emission sensor toward the light reception sensor is cut by the light-shielding plate. The output of the drum sensor 25 at that time is input into the CPU 51 of the control system 50 through connectors 26 and 27 as a drum mount signal.

The drum sensor 25 may comprise a microswitch which is turned on by a projection on the support system 23 when the support system 23 is properly set to the printer body 1*a*.

The support system 23 is provided with a printing matrix size information storage means 28. The printing matrix size information storage means 28 may comprise, for instance, a RAM, EEPROM, flash memory or the like and stores information on the printing matrix size. The storage means 28 is electrically connected with the CPU 51 of the control system 50 by way of the connectors 26 and 27 to enable read out and write of printing matrix size information when the support system 23 is properly set to the printer body 1*a*.

The pressure roller 20 is substantially the same as the printing drum 19 in diameter and is disposed below the drum 19. The pressure roller 20 is disposed in parallel to the drum 19 with its circumferential surface spaced from that of the drum 19 by a predetermined distance. The pressure roller 20 is rotated about its longitudinal axis 20*a* in the clockwise direction in FIG. 1 at the same speed as the drum 19 in synchronization therewith by a synchronized drive system (not shown). A recess 29 is formed on the circumferential surface of the pressure roller 20 and receives the clamp 21 on the drum 19 when the clamp 21 comes to be in contact with the pressure roller 20, thereby preventing the clamp 21 from interfering with the pressure roller 20. The pressure roller 20 holds the leading end of a printing paper sheet 34 fed from the paper feed section 5 at a paper take-up position a with its clamp means (not shown) and causes the clamp means to release the paper sheet 34 at a paper release portion b.

The paper feed section 5 is disposed on the left side below the printing section 4 as shown in FIG. 1. The paper feed section 5 comprises a paper feed table 30, a pair of paper feed rollers 31, a paper separation roller 32 and a pair of paper supply rollers 33. On the paper feed table 30, a stack of a plurality of printing paper sheets 34 are placed. When printing is to be started, the paper feed table 30 is moved upward by an up-and-down mechanism (not shown) to a predetermined position relative to the paper feed rollers 31 where the uppermost printing paper sheet 34 in the stack on the paper feed table 30 is in contact with the paper feed rollers 31. Then the paper feed rollers 31 and the paper separation roller 32 separates the uppermost paper sheet 34 from the stack and the paper supply rollers 33 supplies the printing paper sheet 34 to the paper take-up position a of the pressure roller 20 at a predetermined timing.

The paper feed table 30 is provided with a pair of side fences 35 and 36, as shown in FIG. 3, which are disposed on opposite sides of the path of feed of the printing paper sheet 34 to be movable in perpendicular to the center line 37 of the path in order to define the positions of the side edges of the sheet 34. The side fences 35 and 36 are respectively provided with racks 38 and 39 which are in mesh with a pinion 40 mounted on the paper feed table 30 to be rotatable about a point of the center line 37.

With this arrangement, the side fences 35 and 36 are interlocked with each other to be moved toward and away from the center line 37 in synchronization with each other.

A sheet width sensor 41 is connected to the pinion 40. The sheet width sensor 41 may comprise, for instance, a potentiometer in which a value of a resistor is changed in response to rotation of the pinion 40 and the electric current flowing through the potentiometer changes. The value of the electric current output from the sheet width sensor 41 is converted to information on the amount of movement of the side fences 35 and 36 and is input into the CPU 51 of the control system 50.

A sheet length sensor 42 is disposed in the rear end portion of the paper feed table 30. The sheet length sensor 42 may comprise, for instance, a reflective optical sensor. The sheet length sensor 42 outputs a detection signal to the CPU 51 when a printing paper sheet 34 covers the detecting surface thereof and a non-detection signal when no sheet covers the same.

A sheet sensor 43 is disposed in the front end portion of the paper feed table 30. The sheet sensor 43 may comprise, for instance, a reflective optical sensor. The sheet sensor 43 outputs a signal representing that there exist sheets to the CPU 51 when a printing paper sheet 34 covers the detecting surface thereof and a signal representing that there exists no sheet when no sheet covers the same.

The paper discharge section 6 is disposed on the right side below the printing section 4 in FIG. 1. The paper discharge section comprises a pair of pinch rollers 44 (44*a* and 44*b*), a discharge claw 45, a discharge roller 46 and a paper discharge table 47. One 44*a* of the pinch rollers is in contact with the pressure roller 20 and the other 44*b* is in contact with the discharge roller 46. The pinch rollers 44 are disposed near the paper release portion b and are associated with the pressure roller 20 to convey the sheet 34. The discharge claw 45 separates the printed sheet 34 from the pressure roller 20. The discharge roller 46 pinches together with the pinch roller 44*b* the printed sheet 34 separated from the pressure roller 20 to convey it to the sheet discharge table 47. The printed sheets 34 thus discharged are stacked on the sheet discharge table 47.

The stencil discharge section 7 is disposed on the left side above the printing section 4 in FIG. 1. The stencil discharge section 7 comprises a pair of stencil discharge rollers 49 which peel the stencil from the drum 19 and convey it into a discharged stencil box 48.

FIG. 3 shows the control system 50 which controls the respective sections of the stencil printer 1 including the paper feed section 5.

As shown in FIG. 3, the control system 50 comprises a one-chip microcomputer provided with a CPU 51 (a control means such as a micro processor), a ROM 52 (a storage means), and a RAM 53.

The CPU 51 controls start and stop of printing operation on the basis of operation of a start key and a stop key on a control panel 54.

The CPU 51 detects the image area on the original on the basis of image data input from the image read-out section 2.

The CPU 51 determines the size of the printing paper sheet 34 as shown in the following table 1 on the basis of information on the width of the sheet 34 from the sheet width sensor 41 and information on whether the paper exists from the sheet length sensor 42. For example, when the information from the sheet width sensor 41 indicates that the width of the sheet 34 is 302 to 292 mm and the information from the sheet length sensor 42 indicates that a sheet 34 exists over the detecting surface thereof, the CPU 51 determines that the sheet size is A3 and is positioned lengthwise.

TABLE 1

| width information (mm) | length sensor signal | sheet size |
|---|---|---|
| 302 to 292 | exist | A3 lengthwise |
| | not exist | A4 sidewise |
| 262 to 252 | exist | B4 lengthwise |
| 215 to 205 | not exist | A4 lengthwise |
| 187 to 177 | not exist | B5 lengthwise |
| 105 to 95 | not exist | postcard |

The CPU 51 determines whether another sheet stack has been placed on the paper feed table on the basis of the signal from the sheet sensor 43. That is, when a signal representing that there exists no sheet is input after input of a signal representing that there exist sheets and then a signal representing that there exist sheets is subsequently input, the CPU 51 determines that another sheet stack has been placed on the paper feed table.

The CPU 51 determines whether removal and mounting of the support system 23 occurred on the basis of a signal input from the drum sensor 25. Specifically the CPU determines that the drum 19 has been mounted on the printer body 1*a* when the support system 23 is properly set to the printer body 1*a* and a drum mount signal is input from the drum sensor 25 by way of the connectors 26 and 27. When no drum mount signal is input, the CPU 51 determines that no drum is on the printer body 1*a*.

The CPU 51 transfers image data for each line from the image read-out section 2 to the image recording section 3.

The CPU 51 reads out and writes printing matrix size information from and in the drum side printing matrix size information storage means 28.

An error alarm 55 is connected to the CPU 51. The error alarm 55 makes a display to the effect that there is fear that the pressure roller 20 can be stained with ink when the CPU 51 determines that the printing area on the printing paper sheet 34 is not larger than the printing matrix area on the stencil. Further when an alarm switch in the CPU 51 is turned on in the printing matrix size determination processing to be described later, the error alarm 55 makes a display to the effect that there is fear that a part of the printing matrix area is cut on the printed image, thereby indicating that there is a potential that a portion of the image was not transferred to the printed image on the printing paper sheet 34.

The ROM 52 stores a processing program required for the CPU 51 to execute a series of processing, sheet size information for determining the size of the printing paper sheet, and data such as information on the margin for determining the printing area of the printing paper sheet 34.

The RAM 53 stores data obtained by processing by the CPU 51, the image data on the original, information on the size of the original, information on the image area on the original, information on the size of the printing paper sheet, information on the printing area on the printing paper sheet, information on the size of the printing matrix area on the stencil, and the like.

The operation of the stencil printer with the arrangement described above will be described with reference to FIGS. 4 to 6, hereinbelow.

An original is placed in the image read-out section 2 and the image scanner 9 is moved (pre-scan) on the original in the direction of sub-scanning (longitudinal direction of the original), thereby reading out the image on the original line by line and at the same time detecting the image area (W1 in width and L1 in length, FIG. 6B) on the original (S10). The image area may be detected in various known manners. A technique for detecting the image area is disclosed in U.S. Pat. No. 4,763,200 for Nakatani et al.

Then the sheet size of the printing paper sheet 34 is detected on the basis of information on the width of the sheet 34 from the sheet width sensor 41 and information on whether the paper exists from the sheet length sensor 42 (S20).

When the sheet size of the printing paper sheet 34 is determined, processing for determining the size of the printing matrix area on the stencil is performed (S100). In the processing for determining the size of the printing matrix area, the printing area on the sheet 34 is first determined (S101 in FIG. 5). The printing area is determined on the basis of the sheet size detected in S20 taking into account the margin (S101). As shown in FIG. 6A, margin ΔW is taken on each end portion of the sheet 34 and margin ΔL is taken on each edge portion of the same, whereby the width W3 and the length L3 of the printing area are determined.

Then the width W3 of the printing area is compared with the width W1 of the image area of the original (S102). When the former is smaller than the latter (S102:NO), the width W4 of the printing matrix area is determined to be the width W3 of the printing area and the alarm switch in the CPU 51 is turned on (S103).

When the width W3 of the printing area is not smaller than the width W1 of the image area on the original (S102:YES), the width W4 of the printing matrix area is determined to be the width W1 of the image area on the original (S104).

Then the length L3 of the printing area is compared with the length L1 of the image area of the original (S105). When the former is smaller than the latter (S105:NO), the length L4 of the printing matrix area is determined to be the length L3 of the printing area and the alarm switch in the CPU 51 is turned on (S106).

When the length L3 of the printing area is not smaller than the length L1 of the image area on the original (S105:YES), the length L4 of the printing matrix area is determined to be the length L1 of the image area on the original (S107).

When the alarm switch in the CPU 51 has been turned on as the result of the determination in S102 and/or S105 (S108:YES), an error message to the effect that there is fear that a part of the printing matrix area is cut on the printed image is output to the error alarm 55 (S109), thereby indicating that there is a potential that a portion of the image was not transferred to the printed image on the printing paper sheet 34.

When the alarm switch has not been turned on (S108:NO), then S200 is performed.

In S200, the printing matrix area size information thus determined (W4 in width and L4 in length) is transferred to the drum side printing matrix size information storage means 28 (S200).

After the printing matrix area size information transferred from the CPU 51 is stored in the printing matrix size information storage means 28, image recording is effected while effecting image read-out (S210). That is, in S210, the image scanner 9 in the image read-out section 2 is moved on the original in the sub-scanning direction to read out the image on the original line by line and the image data obtained is transferred to the image recording section 3 to drive the thermal head 14 according to the image data, thereby thermally recording the image on the stencil material as a pattern of perforations over the printing matrix area determined.

Then the imagewise perforated stencil is mounted on the drum 19 (S220). That is, the leading end of the stencil is held by the clamp 21 and the stencil is wrapped around the drum 19 in response to rotation of the drum 19.

Figure 4:
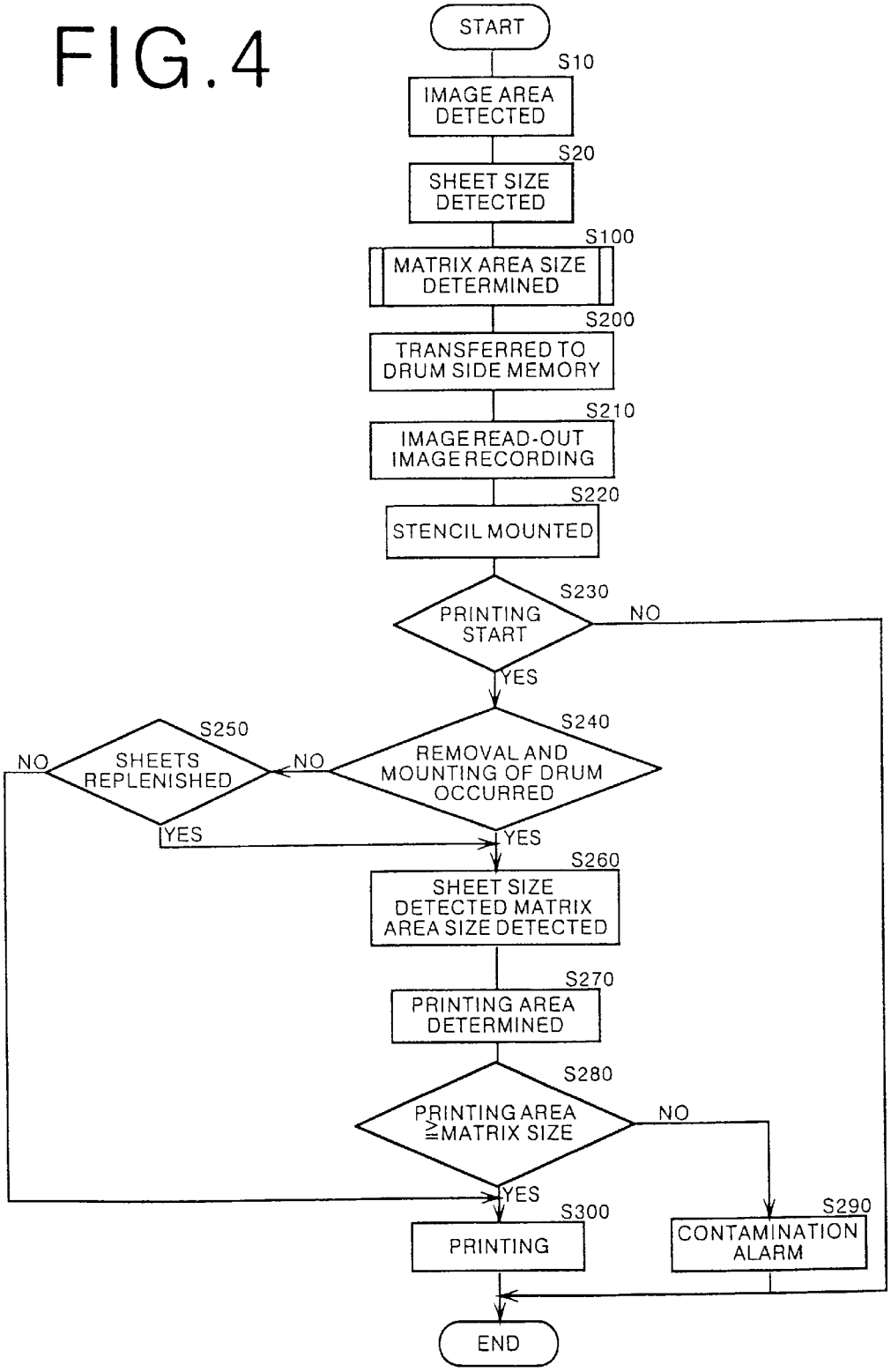
FIG. 4 is a flow chart for illustrating the operation of the printer.

When the start key on the control panel 54 is not pushed in this state (S230:NO), the flow shown in FIG. 4 is ended.

When the start key is pushed (S230:YES), it is determined whether removal and mounting of the drum 19 occurred on the basis of the signal from the drum sensor 25 (S240).

When it is determined that removal and mounting of the drum 19 did not occur (S240:NO), it is determined whether a new stack of printing paper sheets was put on the paper feed table 30 (S250).

When it is determined that a new stack of printing paper sheets was not put on the paper feed table 30 (S250:NO), printing is performed (S300).

When it is determined that removal and mounting of the drum 19 occurred (S240:YES), or when it is determined that a new stack of printing paper sheets was put on the paper feed table 30 (S250:YES), the sheet size of the printing paper sheets 34 is detected again and the printing matrix area size is read out from the drum side printing matrix area information storage means 28 (S260).

Then the printing area (W3 in width and L3 in length) is determined on the basis of the sheet size of the printing paper sheets 34 detected (S270). When the printing area determined is not smaller than the printing matrix area (W4 in width and L4 in length in FIG. 6C) in both width and length (S280:YES), printing is performed (S300). As shown in FIG. 4, this second detection of the sheet size (S260) and determining the printing area (S270) occurs only when it is determined that either removal and mounting of the drum 19 occurred (S240:YES) or new printing paper sheets was put on the paper feed table 30 (S250:YES). This is because if either of these events have occurred, there exists a chance that the new drum or the new paper is of a different size than that which was removed. If the drum 19 or the printing paper sheets 34 are replaced with a drum or paper having a different size, the potential exists that the sheet size will be smaller than the printing matrix size and that the image on the printing matrix area will be cut when transferred to the printing paper, i.e. a portion of the image may not transfer to the printing paper and the alarm will be provided (S290). In addition, as noted above, the printing matrix area size is read out from the information storage means so that redetermination ofthe printing matrix area (S100) will not be required. If the drum or paper is not replaced, then there will be no chance that the sheet size will be smaller than the printing matrix size and no alarm will be provided but rather, the print will occur (S300).

In the printing operation, the paper feed section 5 supplies the sheets 34 one by one. The leading end of the sheet 34 is held by the clamp means of the pressure roller 20 and is fed between the pressure roller 20 and the drum 19 in response to rotation of the pressure roller 20. The drum 19 is rotated in synchronization with the pressure roller 20 and the sheet 34 is conveyed pinched therebetween.

The inner pressure roller 22 is rotated in synchronization with the drum 19 and the pressure roller 20 and causes the circumferential wall of the drum 19 to bulge outwardly. The sheet 34 is sandwiched between the bulged circumferential wall of the drum 19 and the pressure roller 20. The ink supplied on the inner surface of circumferential wall of the drum 19 is transferred to the sheet 34 through the perforations in the printing matrix area on the stencil, thereby recording an image on the sheet 34 in a predetermined color.

When the printing area is smaller than the printing matrix area (S280:NO), the error alarm 55 makes a display to the effect that there is fear that the pressure roller 20 can be stained with ink (S290).

In the operation of determining the size of the printing matrix area, when it is not necessary to take into account the margin, the printing area is determined to be W2 (FIG. 6A) ×L2 (FIG. 6A) in S101. Then the following steps in the flow shown in FIG. 5 are performed employing W2 and L2 as the width and the length of the printing area in place of W3 and L3, whereby printing is carried out over the entire area of the sheet 34 according the printing matrix area.

Figure 5:
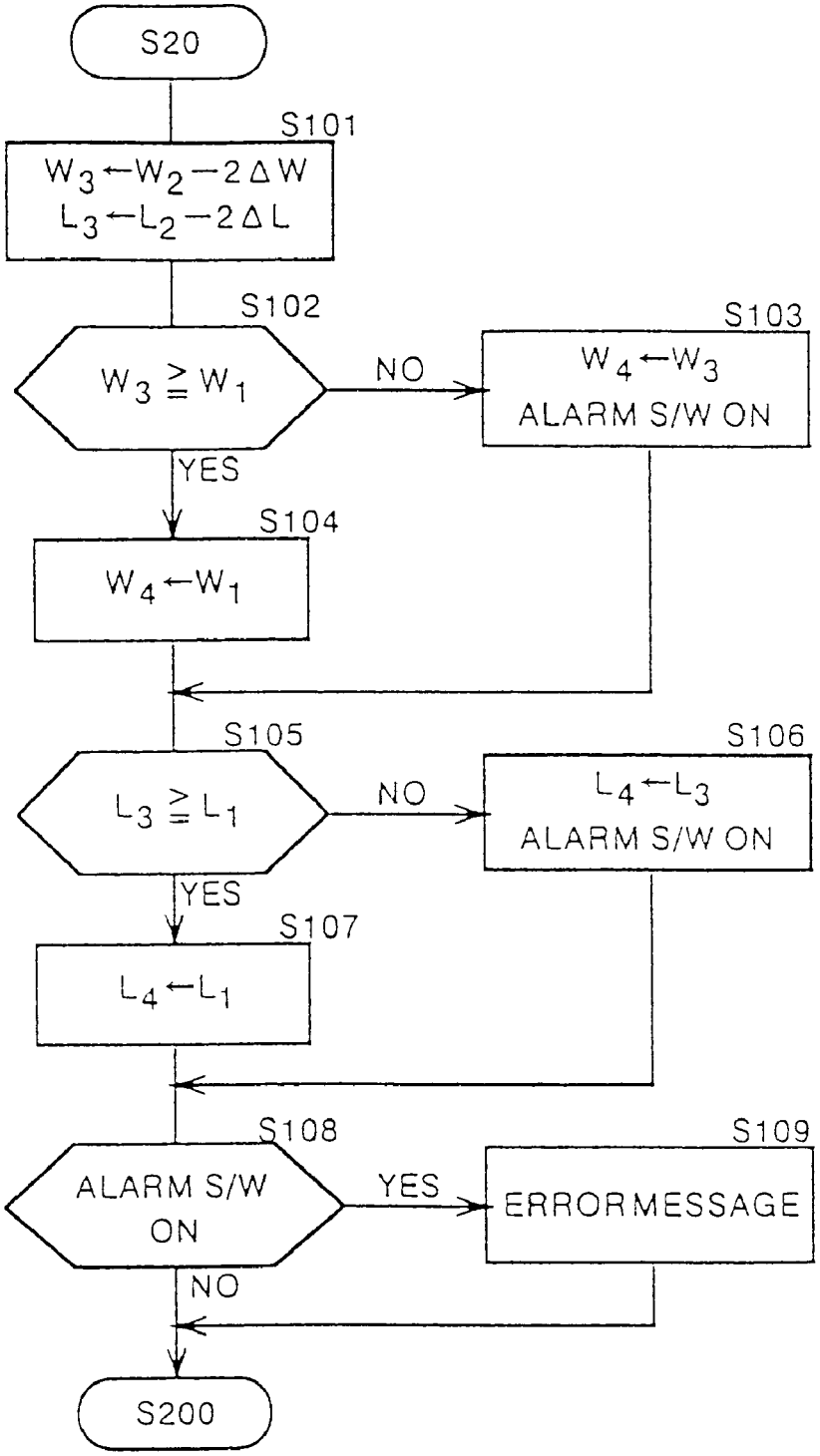
FIG. 5 is a flow chart for illustrating determination of the size of the printing matrix area.
Figure 6A:
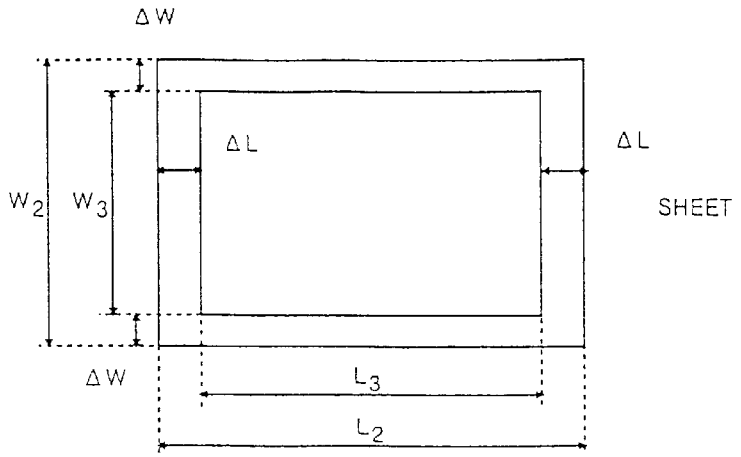
FIG. 6A shows the size of the printing paper sheet and the printing area on the sheet.
Figure 6B:
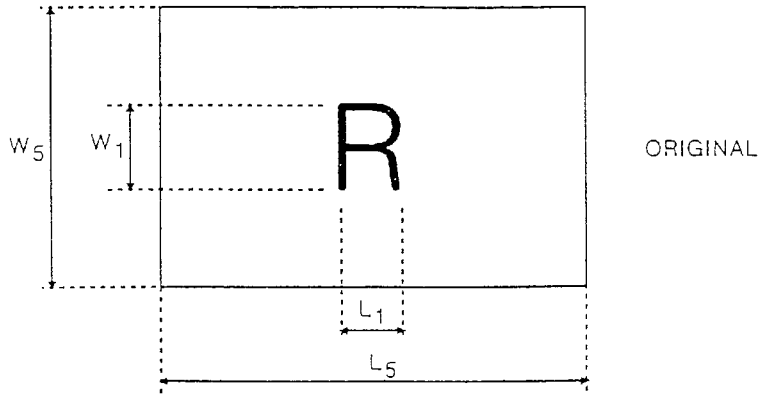
FIG. 6B shows the size of the original and the image area of the original.
Figure 6C:
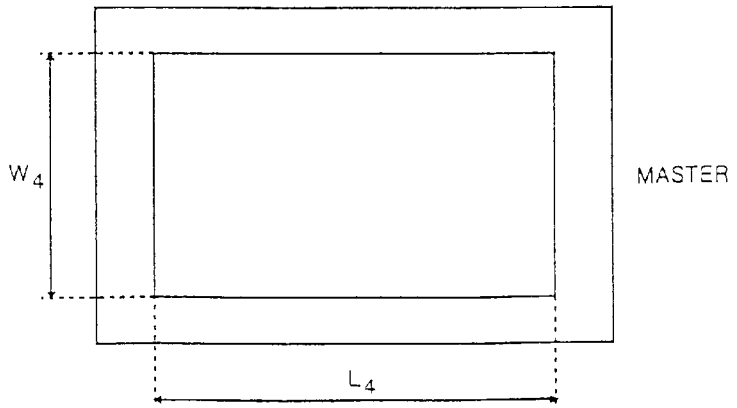
FIG. 6C shows the printing matrix area of the stencil.

When the size of the printing matrix area is determined on the basis of the size of the original, the size of the original (W5×L5) is detected on the basis of information from the original size detecting means 12, and the flow in FIG. 5 is executed employing the width of the original W5 and the length L5 of the original are used in place of the width W1 and the length L1 of the printing matrix area.

Thus in accordance with this embodiment, the pressure roller 20 which is pressed against the drum 19 can be surely prevented from being stained with ink. Further when the size of the printing paper sheet 34 is smaller than the size of the printing matrix area, printing is inhibited and a message to the effect that printing cannot be effected is displayed to alarm the operator. Further the printing matrix area is determined taking into account the margin to be provided on the sheet 34, and when the printing area, the area corresponding to the sheet size minus the margin, is smaller than the printing matrix area, printing is inhibited and a message to the effect that printing cannot be effected is displayed to alarm the operator.

Since the margin is taken into account when the printing matrix area size is determined, a desired print can be recorded in the printing area inside the margin.

Further since the printing matrix area is determined on the basis of comparison of the image area on the original with the printing area on the printing paper sheet 34 which takes into account the margin, the alarm is provided when the printing area is smaller than the image area, and the image on the original cannot be wholly recorded on the printing matrix if the printing matrix area is equal to the printing area is made, a desired printing can be obtained according to the printing matrix area without a part of the image being cut, i.e. without having a portion of the image to be transferred being omitted.

Further even when the printing matrix area is set to be the sheet size, when the printing matrix area determined is smaller than the size of the original, an alarm is provided to indicate that the image on the original cannot be wholly recorded on the printing matrix area. Accordingly a desired printing can be obtained according to the printing matrix area without a part of the image being cut, i.e. without having a portion of the image to be transferred being omitted.

Further when the printing matrix area is determined on the basis of comparison of the size of the original with the size of the printing paper sheet 34, printing is carried out over the entire area of the sheet 34 according the printing matrix area.

Figure 7:
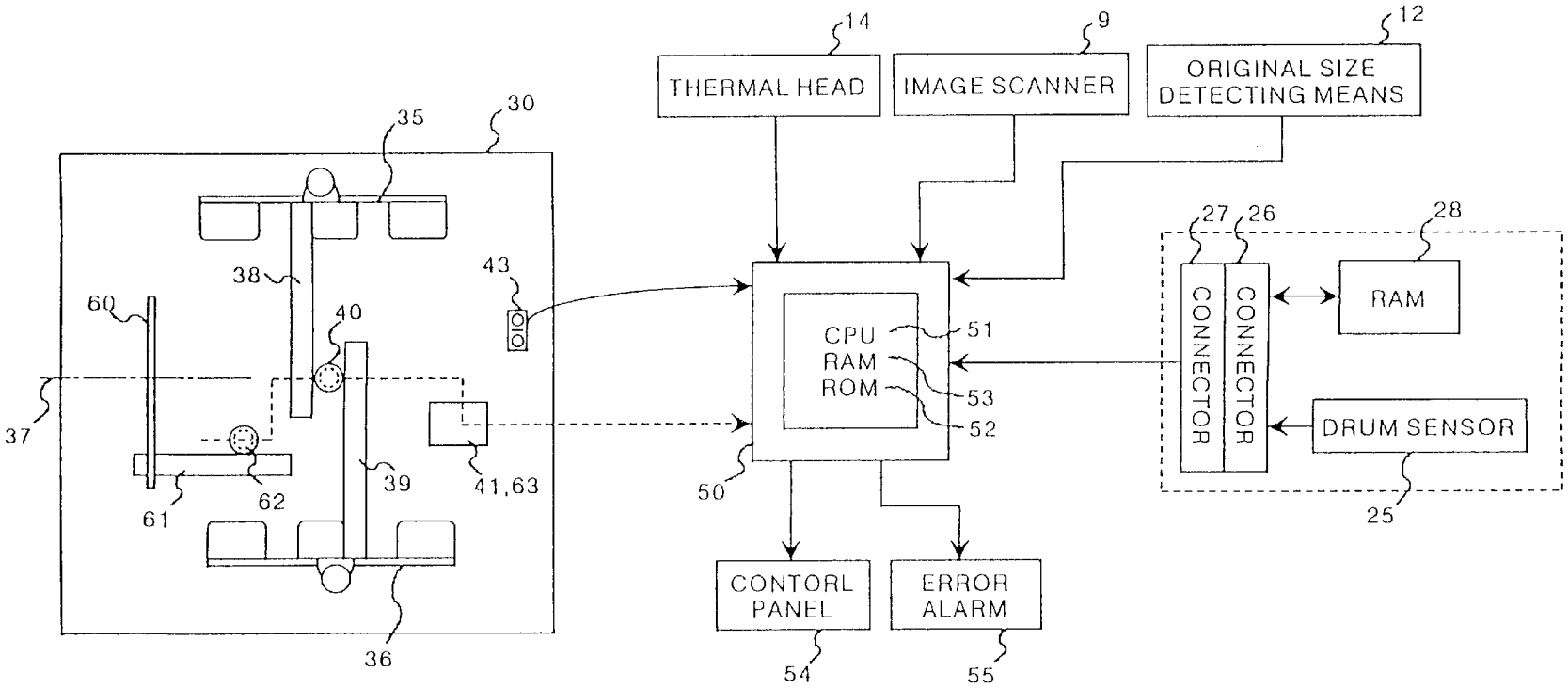
FIG. 7 is a view similar to FIG. 3 but for illustrating a stencil printer in accordance with another embodiment of the present invention.

Though, in the embodiment described above, the length of the sheets 34 on the paper feed table 30 is detected by the sheet length sensor 42 which is a reflective optical sensor, the length of the sheets 34 may be detected by an arrangement shown in FIG. 7. In FIG. 7, the components analogous to those shown in FIG. 3 are given the same reference numerals and will not be described here.

In FIG. 7, the paper feed table 30 is provided with an end fence 60 which defines the position of the trailing end of the sheets 34 on the feed table 30. The end fence 60 is movable in the direction of the center line 37 of the path of conveyance of the printing paper sheet 34 along a guide rail (not shown). The end fence 60 is provided with a rack 61 which is in mesh with a pinion 62 which is supported on the paper feed table 30 to be rotatable about a point.

The amount of movement of the end fence 60 is detected by a sheet length sensor 63 connected to the pinion 62. The sheet length sensor 63 may comprise, for instance, a potentiometer as the sheet width sensor 41 and inputs sheet length information to the CPU 51 according to the amount of movement of the end fence 60.

With this arrangement, even if the printing paper sheets 34 placed on the paper feed table is of an irregular size, the CPU 51 can recognize the transverse size and the longitudinal size of the sheets 34 on the basis of information from the sheet width sensor 41 and the sheet length sensor 63.

Though, in the embodiments described above, the CPU 51 detects the sheet size on the basis of information from the sheet width sensor 41 and the sheet length sensor 42 or 63, the CPU 51 may detect sheet size on the basis of sheet size information input by the operator through the control panel 54 or on the basis of both information from the sheet width sensor 41 and the sheet length sensor 42 or 63 and sheet size information input by the operator through the control panel 54.

Though in the embodiments described above, the printing matrix area size information storage means 28 provided on the drum side is connected to the CPU 51 of the control system 50 by way of the connectors 26 and 27 when the drum 19 is mounted on the printer body 1*a*, another CPU may be provided on the drum side and the drum side printing matrix area size information storage means 28 may be connected to the CPU. In this case, read out and write of printing matrix size information from and in the drum side printing matrix size information storage means 28 are controlled through communication between the CPU 51 of the control system 50 and the drum side CPU.

The present invention may be applied to various stencil printers without limiting to that shown in FIG. 1. For example, the present invention may be applied to a stencil printer comprising a cylindrical drum on which a stencil can be mounted and which is provided with an ink supply section disposed inside the drum, and a pressure roller which is movable into contact with the drum to press a printing paper sheet against the drum and away therefrom by, for instance, a cam mechanism.

As can be seen from the description above, in accordance with the present invention, the pressure member which is pressed against the printing drum can be surely prevented from being stained with ink during printing. Further when the size of the printing paper sheet is smaller than the size of the printing matrix area, printing is inhibited and a message to the effect that printing cannot be effected is displayed to alarm the operator.

Further even when the printing matrix area is determined taking into account the margin to be provided on the sheet and the printing area, if the print area corresponding to the sheet size minus the margin, is smaller than the printing matrix area, printing is inhibited and a message to the effect that printing cannot be effected is displayed to alarm the operator.

Even when the printing matrix area is determined on the basis of comparison of the image area on the original with the printing area on the printing paper sheet determined taking into account the margin and the printing matrix area is determined to be the printing area, if the printing area is smaller than the image area, alarm is provided to indicate that the image on the original cannot be wholly recorded on the printing matrix area. Accordingly a desired printing can be obtained according to the printing matrix area without a part of the image being cut, i.e. without having a portion of the image to be transferred being omitted.

Further even when the printing matrix area is set to be the sheet size such as when the printing matrix area determined is smaller than the size of the original, alarm is provided to indicate that the image on the original cannot be wholly recorded on the printing matrix area. Accordingly a desired printing can be obtained according to the printing matrix area without a part of the image being cut.

When the printing matrix area is determined on the basis of comparison of the size of the original with the size of the printing paper sheet, printing is carried out over the entire area of the sheet according to the printing matrix area.

What is claimed:

1. A stencil printer comprising an image recording section which thermally makes a printing matrix on a stencil on the basis of image information representing an image on an original, a printing drum around which the stencil is wrapped, a paper feed section which supports printing paper sheets and feeds the printing paper sheets toward the printing drum, a pressure member which is opposed to the printing drum to effect pressing of the printing paper sheets between the printing drum and the pressure member as the printing paper sheets are fed through the stencil printer, a sheet size sensor provided on the paper feed section for detecting an original sheet size of the printing paper sheets, and a current sheet size of the printing paper sheets, with an original area of the printing matrix to be made by the image recording section being determined according to the original sheet size, a storage means which is provided on the printing drum and stores information on the original area of the printing matrix, and a control system which compares the original sheet size detected by the sheet size sensor or the current sheet size if either the drum has been remounted or the printing paper sheets have been replenished with the area of the printing matrix based on information extracted from the storage means of the currently mounted drum and acts to at least one of inhibit printing and output an error signal which advises against printing when the current sheet size is smaller than the current area of the printing matrix.

2. A stencil printer comprising an image read-out section which optically reads out an image on an original, an image recording section which thermally makes a printing matrix on a stencil on the basis of image information representing the image on the original read out by the image read-out section, a printing drum around which the stencil is wrapped, a paper feed section which supports printing paper sheets and feeds the printing paper sheets toward the printing drum, a pressure member which is opposed to the printing drum to effect pressing of the printing paper sheets between the printing drum and the pressure member as the printing paper sheets are fed through the stencil printer, a sheet size sensor provided on the paper feed section for detecting a sheet size of the printing paper sheets and a current sheet size of the printing paper sheets, with an original area of the printing matrix to be made by the image recording section being determined according to the original sheet size, a storage means which is provided on the printing drum and stores information regarding the original area of the printing matrix, the original area of the printing matrix being determined on the basis of comparison of an image area on the original and a printing area corresponding to the original sheet size minus a predetermined margin, where the original area of the printing matrix is determined to be equal to the image area when the printing area is at least the same as the image area and is determined to be equal to the printing area when the printing area is smaller than the image area, and a control system which compares the original sheet size detected by the sheet size sensor or the current sheet size if either the drum has been remounted or the printing paper sheets have been replenished with the area of the printing matrix based on information extracted from the storage means on the currently mounted drum and acts to at least one of inhibit printing and output an error signal which advises against printing when the current sheet size is smaller than the current area of the printing matrix.

3. A stencil printer as defined in claim 2 further comprising an alarm means for indicating that the image on the original is not correctly represented by the printing matrix when the printing area is smaller than the image area on the original and the area of the printing matrix is determined to be equal to the printing area.

4. A stencil printer comprising an image read-out section which optically reads out an image on an original, an image recording section which thermally makes a printing matrix on a stencil on the basis of image information representing the image on the original read out by the image read-out section, a printing drum around which the stencil is wrapped, a paper feed section which supports printing paper sheets and feeds the printing paper sheets toward the printing drum, a pressure member which is opposed to the printing drum to effect pressing of the printing paper sheets between the printing drum and the pressure member as the printing paper sheets are fed through the stencil printer, a sheet size sensor provided on the paper feed section for detecting an original sheet size of the printing paper sheets and a current sheet size of the printing paper sheets, with an original area of the printing matrix to be made by the image recording section being determined according to the original sheet size, a storage means which is provided on a printing drum side and stores information regarding the original area of the printing matrix, the area of the printing matrix being determined on the basis of comparison of an image area on the original and a printing area corresponding to the original sheet size, where the original area of the printing matrix is determined to be equal to the image area when the printing area is at least the same as the image area and is determined to be equal to the printing area when the printing area is smaller than the image area, and a control system which compares the original sheet size detected by the sheet size sensor or the current sheet size if either the drum has been remounted or the printing paper sheets have been replenished with the area of the printing matrix based on information extracted from the storage means on the current mounted drum and acts to at least one of inhibit printing and output an error signal which advises against printing when the current sheet size is smaller than the current area of the printing matrix.

5. A stencil printer as defined in claim 4 further comprising an alarm means for indicating that the image on the original is not correctly represented by the printing matrix when the printing area is smaller than the image area on the original and the area of the printing matrix is determined to be equal to the printing area.

6. A stencil printer comprising an image read-out section which optically reads out an image on an original, an original detecting means which is provided in the image read-out section and detects the size of the original, an image recording section which thermally makes a printing matrix on a stencil on the basis of image information representing the image on the original read out by the image read-out section, a printing drum around which the stencil is wrapped, a paper feed section which supports printing paper sheets and feeds the printing paper sheets toward the printing drum, a pressure member which is opposed to the printing drum to effect pressing of the printing paper sheets between the printing drum and the pressure member as the printing paper sheets are fed through the stencil printer, a sheet size sensor provided on the paper feed section for detecting an original sheet size of the printing paper sheets and a current sheet size of the printing paper sheets, with an original area of the printing matrix to be made by the image recording section being determined according to the original sheet size, a storage means which is provided on the printing drum and stores information regarding the original area of the printing matrix, the original area of the printing matrix being determined on the basis of comparison of the size of the original detected by the original size detecting means and the sheet size to be equal to the size of the original when the sheet size is not smaller than the size of the original and to be equal to the sheet size when the sheet size is smaller than the size of the original, and a control system which compares the sheet size detected by the sheet size sensor or the current sheet size if either the drum has been remounted or the printing paper sheets have been replenished with the area ofthe printing matrix based on information extracted from the storage means on the current mounted drum and acts to at least one of inhibit printing and output an error signal which advises against printing when the current sheet size is smaller than the current area of the printing matrix.

7. A stencil printer as defined claim 6 further comprising an alarm means for indicating that the image on the original is not correctly represented by the printing matrix when the sheet size is smaller than the size of the original and the area of the printing matrix is determined to be equal to the sheet size.

8. A method of stencil printing wherein a printing matrix is thermally made in a printing matrix area on a stencil material on the basis of image information representing an image on an original comprising the steps of determining an original printing matrix area according to an original size of a printing paper sheet, wrapping a stencil thus obtained around a printing drum, feeding the printing paper sheet toward the printing drum, effecting pressure on the printing paper sheet between a pressure member and the printing drum, causing a storage means provided on a printing side to store information regarding the area of the original printing matrix, selectively replacing the printing drum;

selectively replacing the printing paper sheets;

comparing the original size of the printing paper sheet or a current sheet size if either the drum has been replaced or the printing paper sheets have been replenished with the area of the printing matrix based on information extracted from the storage means on the current mounted drum, and at least one of inhibiting printing and outputting an error signal which advises against printing when the current size of the printing paper sheet is smaller than the current area of the printing matrix.

9. A method of stencil printing wherein a printing matrix is thermally made in a printing matrix area on a stencil material on the basis of image information representing an image on an original comprising the steps of determining an original printing matrix area according to an original size of a printing paper sheet, wrapping a stencil thus obtained around a printing drum, feeding the printing paper sheet toward the printing drum, effecting pressure on the printing paper sheet between a pressure member and the printing drum, causing a storage means provided on the printing drum to store information regarding the original area of the printing matrix, the area of the printing matrix being determined on the basis of comparison of an image area on the original and a printing area corresponding to the original sheet size minus a predetermined margin, where the area of the printing matrix is determined to be equal to the Image area when the printing area is at least the same as the image area and is determined to be equal to the printing area when the printing area is smaller than the image area, selectively replacing the printing drum;

selectively replacing the printing paper sheets;

comparing the original size ofthe printing paper sheet or a current sheet size if either the drum has been replaced or the printing paper sheets have been replenished with the area of the printing matrix based on information extracted from the storage means on the current mounted drum, and at least one of inhibiting printing and outputting an error signal which advises against printing when the current size of the printing paper sheet is smaller than the current area of the printing matrix.

10. A method of stencil printing wherein a printing matrix is thermally made in a printing matrix area on a stencil material on the basis of image information representing an image on an original comprising the steps of determining an original printing matrix area according to an original size of a printing paper sheet, wrapping a stencil thus obtained around a printing drum, feeding the printing paper sheet toward the printing drum, effecting pressure on the printing paper sheet between a pressure member and the printing drum, causing a storage means provided on the printing drum to store information regarding the original area of the printing matrix, the area of the printing matrix being determined on the basis of comparison of an image area on the original and a printing area corresponding to the original sheet size, where the area of the printing matrix is determined to be equal to the image area when the printing area is at least the same as the image area and is determined to be equal to the printing area when the printing area is smaller than the image area, selectively replacing the printing drum;

selectively replacing the printing paper sheets:

comparing the original size of the printing paper sheet or a current sheet size if either the drum has been replaced or the printing paper sheets have been replenished with the area of the printing matrix based on information extracted from the storage means on the current mounted drum, and at least one of inhibiting printing and outputting an error signal which advises against printing when the current size of the printing paper sheet is smaller than the current area of the printing matrix.

11. A method of stencil printing wherein a printing matrix is thermally made in a printing matrix area on a stencil material on the basis of image information representing an image on an original comprising the steps of determining an original printing matrix area according to an original sheet size of a printing paper sheet, wrapping a stencil thus obtained around a printing drum, feeding the printing paper sheet toward the printing drum, effecting pressure on the printing paper sheet between the printing drum and a pressure member, causing a storage means provided on the printing drum to store information regarding the original area of the printing matrix, the area of the printing matrix being determined on the basis of comparison of the size of the original and the sheet size, where the area of the printing matrix is determined to be equal to the size of the original when the original sheet size is not smaller than the size of the original and is determined to be equal to the sheet size when the sheet size is smaller than the size of the original, selectively replacing the printing drum;

selectively replacing the printing paper sheets;

comparing the original sheet size with or a current sheet size if either the drum has been replaced or the printing paper sheets have been replenished the area of the original printing matrix based on information extracted from the storage means on the current mounted drum, and at least one of inhibiting printing and outputting an error signal which advises against printing when the current sheet size is smaller than the current area of the printing matrix.

* * * * *